United States Patent [19]

Nischwitz

[11] 4,002,779

[45] Jan. 11, 1977

[54] PROCESS FOR THE MANUFACTURE OF ELECTROCONDUCTIVE NON-WOVEN FABRICS

[75] Inventor: Ehrenfried Nischwitz, Oberreifenberg, Taunus, Germany

[73] Assignee: Hoechst Aktiengesellschaft, Frankfurt am Main, Germany

[22] Filed: May 23, 1975

[21] Appl. No.: 580,162

[30] Foreign Application Priority Data

May 24, 1974 Germany ..... 2425196

[52] U.S. Cl. ..... 427/124; 427/304; 427/305; 427/306

[51] Int. Cl.[2] ..... B05D 5/12; C23C 3/02

[58] Field of Search ..... 427/58, 88, 89, 92, 427/126, 301, 304, 305, 306, 322, 404, 124; 106/1

[56] References Cited

UNITED STATES PATENTS

| | | | |
|---|---|---|---|
| 3,033,703 | 5/1962 | Scheble et al. | 427/306 X |
| 3,329,512 | 7/1967 | Shipley et al. | 427/404 |
| 3,686,019 | 8/1972 | Ohfuka et al. | 427/306 X |

FOREIGN PATENTS OR APPLICATIONS

| | | | |
|---|---|---|---|
| 1,804,042 | 5/1970 | Germany | 427/306 |
| 47-6078 | 2/1972 | Japan | 427/304 |
| 47-17120 | 5/1972 | Japan | 427/306 |

OTHER PUBLICATIONS

Muller and Baudrand, *Plating on Plastics*, Robert Draper, Ltd., 1971, pp. 16–19 and 57–60.

*Primary Examiner*—Thomas J. Herbert, Jr.
*Assistant Examiner*—Bruce H. Hess
*Attorney, Agent, or Firm*—Curtis, Morris & Safford

[57] ABSTRACT

A process for the manufacture of electroconductive non-woven fabrics which comprises a. cleaning the fabrics with a polar organic solvent and, after elimination of the solvent,
b. sensitizing them with an aqueous hydrochloric acid solution of tin-II chloride,
c. activating them with an aqueous hydrochloric acid solution of palladium chloride, and
d. treating them with a mixture of a tenside-free binder dispersion and a metastable aqueous metal salt solution, and subsequently drying them; the fabrics being rinsed with water after each of the steps (b) and (c) is provided.

3 Claims, No Drawings

PROCESS FOR THE MANUFACTURE OF ELECTROCONDUCTIVE NON-WOVEN FABRICS

The present invention provides a process for the manufacture of electroconductive non-woven fabrics which are reinforced by means of binders.

It is known to obtain electroconductive non-woven fabrics by reinforcing the fabrics with plastics binders to which carbon (soot or graphite) is added. The conductivity obtainable depends substantially on the transition resistance of the individual carbon particles, so that relatively large amounts of carbon must be used to obtain the required conductivity for electric current. The disadvantage of such large amounts of carbon resides in the fact that they result in decrease of cohesion and poor abrasion resistance of the fabrics.

It is furthermore known to improve the electroconductivity of non-conductive fiber materials by applying metal layers to this material, either by cathode atomization or by metallization without current.

While the cathode atomization process requires great expenditure and can only be applied in special cases, metallization without current may for example be carried out as follows: the fibrous material is given a woven or knitted shape, and this fabric, after a thorough washing and treatment in a reductive bath (tin-II chloride) is coated in a chemoreductive manner with metal in a metal salt bath. A disadvantage is the poor abrasion resistance of the coating (adhesion of the metal to the fiber surface).

It is also known to activate fibers with a palladium salt solution after the sensitization and before the metallization, thus causing palladium particles to be deposited onto the fiber in the form of seed crystals which promote the metal precipitation, so that in this case a continuous metal film having a good adhesion is generally obtained.

It is also known to apply the cited process to textile fabrics, that is, woven or knitted fabrics etc.. The process is disadvantageous for non-woven fabrics which have to be reinforced preliminarily by needles and/or binders, and it is especially disadvantageous in the case of metallizing bonded non-woven fabrics.

It is therefore the object of the present invention to provide a process which comprises reinforcing and metallizing non-woven fabrics in one single operation.

In accordance with the present invention, there is provided a process for the manufacture of electroconductive non-woven fabrics which comprises a. cleaning the fabrics with a polar organic solvent and, after elimination of the solvent, b. sensitizing them with an aqueous hydrochloric acid solution of tin-II chloride, c. activating them with an aqueous hydrochloric acid solution of palladium chloride, and d. treating them with a mixture of a tenside-free binder dispersion and a metastable aqueous metal salt solution, and subsequently drying them; the fabrics being rinsed with water after each of the steps (b) and (c).

As polar organic solvent, there may be used chlorinated hydrocarbons, for example methylene chloride or trichloroethylene.

The sensitizer solution may for example consist of 10 g of tin-II chloride and 40 ml of concentrated hydrochloric acid in 1 l of water. The solution has a pH of 1 to 1.3. The sensitization is carried out at room temperature within 10 to 15 minutes.

For the aqueous hydrochloric acid solution of palladium chloride, 1 g of palladium chloride and 10 ml of concentrated hydrochloric acid are added to 1 l of water (pH 1). The fabric is treated at room temperature for 15 to 20 minutes.

As aqueous metal salt solution, for example, the following mixtures are suitable:

1. copper bath 20 g/l of sodium hydroxide (100%)
69 g/l of crystallized sodium-potassium tartrate
14 g/l of copper sulfate · 5 $H_2O$
40 g/l of formaldehyde (35%)
200–300 g/l of polymer binder 2. nickel bath 20 g/l of sodium biphosphate
40 g/l of sodium-potassium tartrate
20 g/l of nickel sulfate · 6 $H_2O$
200–300 g/l of polymer binder The fabric is treated in the copper bath for 8 to 10 minutes at room temperature, while in the case of the nickel bath, the fabric is immersed at room temperature and the bath is heated slowly to 90° C. After about 15 to 50 minutes, the nickel plating is complete, which becomes manifest by the termination of hydrogen formation. After each of steps (b) and (c), the fabric is rinsed with water in order to avoid portions of the baths being carried along. Finally, the fabric is dried at room or elevated temperature. As polymer binder, 50 to 55% aqueous dispersions of butadiene/acrylonitrile copolymers (monomer ratio 50:50 to 80:20) may be used, optionally also with polymerization incorporation of acrylic acid; or 45 to 55% aqueous dispersions of an acrylic or methacrylic copolymer, consisting for example of 45 – 55 weight % of an acrylic or methacrylic acid ester, 24 – 30 weight % of acrylonitrile, 12.5 – 30.5 weight % of styrene, 0.5 – 2.5 weight % of acrylic acid amide and 1 – 3 weight % of acrylic acid, containing furthermore a cellulose ether or polyvinyl alcohol as protective colloid and emulsifier; or 50 to 60% aqueous dispersions of a polyvinyl acetate homo- or copolymer, the comonomers being for example ethylene, dibutyl maleinate, vinyl chloride or other substances having at least a double bond. Also in the latter case, cellulose ethers may be added as protective colloid. The process is especially suitable for metallizing chopped strands mats and non-woven fabrics made from polyester or polyamide fibers.

The non-woven fabrics manufactured according to the present invention have an uninterrupted, compact metal film which permits the use of the material as a genuine electric conductor such as required for example in the case of filter material for electrostatic systems or of surface heating conductors. The metal layer of the fabrics amounts to 1 to 50 weight %, preferably 12 to 24 weight %, relative to the fabric. The surface resistance, as reciprocal value of the electroconductivity, measured on conductive silver contacts, is from 30 to 80 Ohms/cm$^2$ in the case of copper, and from 80 to 150 Ohms/cm$^2$ in the case of nickel, and it depends on the density and weight of the non-woven fabric as well as on the thickness of the metal layer.

The following examples illustrate the invention.

EXAMPLE 1

A chopped strands mat made of polyester fibers and having a weight of 200 g/m$^2$ is washed with methylene chloride and dried. Subsequently, it is sensitized for about 20 minutes at room temperature in a solution containing 10 g/l of tin-II chloride and 40 ml of concentrated hydrochloric acid, and then washed with deionized water. The mat so treated is subsequently activated for about 15 minutes at room temperature in a bath containing 1 g/l of palladium chloride and 15 ml/l of concentrated hydrochloric acid. After a short rinsing with deionized water, the mat is treated for 40 minutes at temperatures which are raised from room temperature to 90° C with a mixture consisting of 250 g/l of a 50% aqueous butadiene/acrylonitrile dispersion, 20 g/l of nickel sulfate · 6 $H_2O$, 40 g/l of potassium-sodium tartrate and 20 g/l of sodium hypophosphite. Subsequently, the mat is squeezed and dried at 120° C, which drying causes the binder to coagulate. Optionally, the fabric may be rinsed again with water. A non-woven fabric having a metal layer of 15 weight % relative to the fabric is obtained. The surface resistance is measured on conductive silver contacts (distance 10 cm) and amounts to 120 Ohms/cm$^2$.

EXAMPLE 2

A carded non-woven fabric made of polyester fibers and having a weight of 80 g/m$^2$ is slightly needled. Subsequently, the fabric is treated with methylene chloride and dried. Sensitizing and activating as described in Example 1 follow. After the intermediate rinsing with cold water, the fabric is treated while being slightly moved with a mixture consisting of 300 g/l of a 50% aqueous dispersion of a copolymer of acrylic acid ester, acrylonitrile, styrene, acrylamide and acrylic acid, and a cellulose ether as protective colloid, 13.8 g/l of copper sulfate · 5 $H_2O$, 69.2 g/l of potassium-sodium tartrate, 20 g/l of sodium hydroxide solution, 40 g/l of formaldehyde (25%). The residence time in this bath is 50 minutes. Subsequently, the fabric is squeezed and dried at 140° C.

A non-woven fabric having a metal layer of 22 weight % and a binder layer of 20 weight % relative to the total weight of the fabric is obtained. The surface resistance is 45 Ohms/cm$^2$.

EXAMPLE 3

A carded non-woven fabric made of polyamide fibers having a weight of 150 g/m$^2$ is treated as indicated in Example 2. A non-woven fabric having a metal layer of 19 weight % relative to the total weight of the fabric is obtained. The surface resistance is 95 Ohms/cm$^2$.

EXAMPLE 4

A slightly needled chopped strands mat of polyester having a weight of 300 g/m$^2$ is precleaned, sensitized and activated as indicated in Example 1. After the last rinsing with cold water, the fabric is immersed in a bath having the following composition:

20 g/l of sodium biphosphate
40 g/l of sodium-potassium tartrate
20 g/l of nickel sulfate · 6 $H_2O$
300 g/l of a 50% aqueous dispersion of a copolymer of vinyl acetate/ethylene at a ratio of 84:16.

The impregnation is carried out at room temperature, subsequently, the temperature is raised within 35 minutes to 90° C, and the fabric, after a further 10 minutes, is removed from the bath, squeezed and dried at 100° C.

The fabric so treated has a nickel layer of 21%. The surface resistance is 105 Ohms/cm$^2$.

What is claimed is:

1. A process for the manufacture of electroconductive, non-woven fabrics which comprises the steps of (a) cleaning a non-woven fabric with a polar organic solvent, (b) sensitizing the fiber surfaces of the fabric with an aqueous hydrochloric acid solution of tin-II chloride, (c) rinsing the fabric with water, (d) activating the fiber surfaces with an aqueous hydrochloric acid solution of palladium chloride, (e) again rinsing the fabric with water, and (f) treating the sensitized and activated fiber surfaces of the non-woven fabric with a mixture of an aqueous tenside-free dispersion of an organic polymeric binder and a metastable aqueous metal salt solution to deposit said metal on said fiber surfaces.

2. A process for the manufacture of an electroconductive, non-woven fabric which comprises (a) cleaning the fabric with a chlorinated organic solvent, (b) sensitizing the fiber surfaces of the non-woven fabric with an aqueous hydrochloric acid solution of tin-II chloride, (c) rinsing the fabric with water, (d) activating the fiber surfaces with an aqueous hydrochloric acid solution of palladium chloride, (e) again rinsing the fabric with water, and (f) treating the fiber surfaces of the fabric with a mixture of an aqueous tenside-free dispersion of an organic polymeric binder and an aqueous solution of a metal salt selected from copper and nickel salts to deposit said metal on the fiber surfaces of said fabric.

3. A process according to claim 1 wherein said polymeric binder is selected from the group consisting of butadiene/acrylonitrile copolymers, acrylic and methacrylic copolymers and polyvinyl acetate homopolymers and copolymers.

* * * * *